United States Patent [19]

Osgood

[11] 4,232,998

[45] Nov. 11, 1980

[54] METHOD AND APPARATUS FOR REGULATING ELECTROLYTE SOLUTION LEVEL IN A LIQUID RHEOSTAT

[76] Inventor: George M. Osgood, 4474 SW. Arthur Way, Portland, Oreg. 97221

[21] Appl. No.: 887,634

[22] Filed: Mar. 17, 1978

[51] Int. Cl.[3] ..... F04B 49/06

[52] U.S. Cl. ..... 417/36; 417/38; 417/45; 417/53

[58] Field of Search ..... 417/36, 38, 40, 44, 417/45; 137/192, 395; 307/118; 318/482

[56] References Cited

U.S. PATENT DOCUMENTS

| | | | |
|---|---|---|---|
| 515,241 | 2/1894 | Lyon | 338/84 |
| 963,163 | 7/1910 | Mackintosh | 338/86 |
| 1,346,898 | 7/1920 | Kingsbury | 417/36 X |
| 1,744,505 | 1/1930 | Robinson | 219/288 |
| 1,885,373 | 11/1932 | Planche | 318/396 |
| 2,246,295 | 6/1941 | Cook | 318/826 |
| 2,734,458 | 2/1956 | Hayes | 417/36 |
| 2,735,057 | 2/1956 | Schaelchlin et al. | 318/826 |
| 3,021,789 | 2/1962 | Ryden | 417/36 |
| 3,123,005 | 3/1964 | Bredehoeft et al. | 417/45 |
| 3,213,795 | 10/1965 | Parks et al. | 417/36 |
| 3,263,616 | 8/1966 | Hyde | 417/45 |
| 3,424,090 | 1/1969 | Hyde | 417/36 |
| 3,431,858 | 3/1969 | Lynn et al. | 417/36 X |
| 3,477,460 | 11/1969 | Dotto | 137/392 |

OTHER PUBLICATIONS

"Variable Speed Control Systems", General Electric, May, 1963.

*Primary Examiner*—Carlton R. Croyle
*Assistant Examiner*—Edward Look
*Attorney, Agent, or Firm*—Kolisch, Hartwell & Dickinson

[57] ABSTRACT

A method and apparatus for regulating electrolyte solution level in a liquid rheostat. The liquid rheostat is used to control the motor speed of a primary pump which is operable for pumping liquid from a well. The liquid rheostat includes an electrode compartment mounted above an electrolyte solution reservoir and solution from the compartment may drain into the reservoir. A conduit interconnects the reservoir with the compartment and a circulating pump, driven by a variable speed electric motor, is operable for delivering solution from the reservoir to the compartment. A sensor is immersed in the well and develops a signal proportional to the amount of liquid in the well. The signal is received by a motor control which operates to vary the speed of the circulating pump motor, and thus the solution level in the compartment, reflective of liquid level in the well.

9 Claims, 3 Drawing Figures

METHOD AND APPARATUS FOR REGULATING ELECTROLYTE SOLUTION LEVEL IN A LIQUID RHEOSTAT

BACKGROUND AND SUMMARY OF THE INVENTION

The present invention relates to liquid rheostats used in liquid pumping systems, and more particularly to a novel method and apparatus for regulating electrolyte solution level in a liquid rheostat.

Liquid rheostats have been advantageously employed in controlling motor speed of a primary pump used for pumping liquid, such as sewage, from a sump or well. As is conventional, a liquid rheostat may include an electrode compartment which is mounted adjacent an electrolyte solution reservoir, and a circulating pump is used to circulate the electrolyte solution from the reservoir into the compartment. Extending from the bottom of the electrode compartment is a conduit for returning the electrolyte solution to the reservoir. Typically, a pneumatically-operated valve is used for regulating the amount of electrolyte solution being returned. The valve may be controlled by an electrical signal which originates from a sensor immersed in the liquid in the well. It can be seen that the electrical signal must be converted to a pneumatic signal for operating the valve.

Thus, depending upon liquid level in the well, the regulating valve is actuated to permit selected amounts of electrolyte solution to be returned into the reservoir. The circulating pump is driven by a constant speed electric motor thereby resulting in a constant recirculating rate of electrolyte solution. The electrolyte solution level in the electrode compartment may be adjusted only by means of operation of the regulating valve.

Generally, regulating valves, as described above, are pneumatically actuated while the sensors immersed in the well may directly sense pressure or level and produce an electrical signal. Conversion of the electrical signal into a pneumatic signal requires expensive controllers which may need considerable maintenance and are nonetheless subject to failure.

Accordingly, it is a general object of the present invention to eliminate the use of a regulating valve in a liquid rheostat by providing a variable speed electric motor for driving the circulating pump which circulates electrolyte solution from the reservoir to the electrode compartment. By varying the speed of the electric motor, the electrolyte solution level in the electrode compartment may be selectively regulated in order to control the operating speed of the motor which drives the primary pump used in pumping liquid from the well. Use of a regulating valve to meter flow from the electrode compartment to the reservoir is unnecessary.

Another object of the present invention is to provide a circulating pump driven by a variable speed electric motor which is controlled by a sensor immersed in the well. More specifically, it is an object to provide a sensor which will produce an electrical signal to a motor control indicative of the amount of liquid in the well. The motor control then directly regulates the speed of the variable speed electric motor driving the circulating pump.

It is another object of the present invention to provide a unitary cabinet assembly mounted above the primary pump. The cabinet assembly houses the liquid rheostat, including the electrode compartment, reservoir, the circulating pump and its variable speed electric motor together with the motor control.

These and additional objects and advantages of the present invention will be appreciated from a consideration of the drawings and the following detailed description of the preferred embodiment.

DETAILED DESCRIPTION OF THE PREFERRED EMBODIMENT

Figure 1:
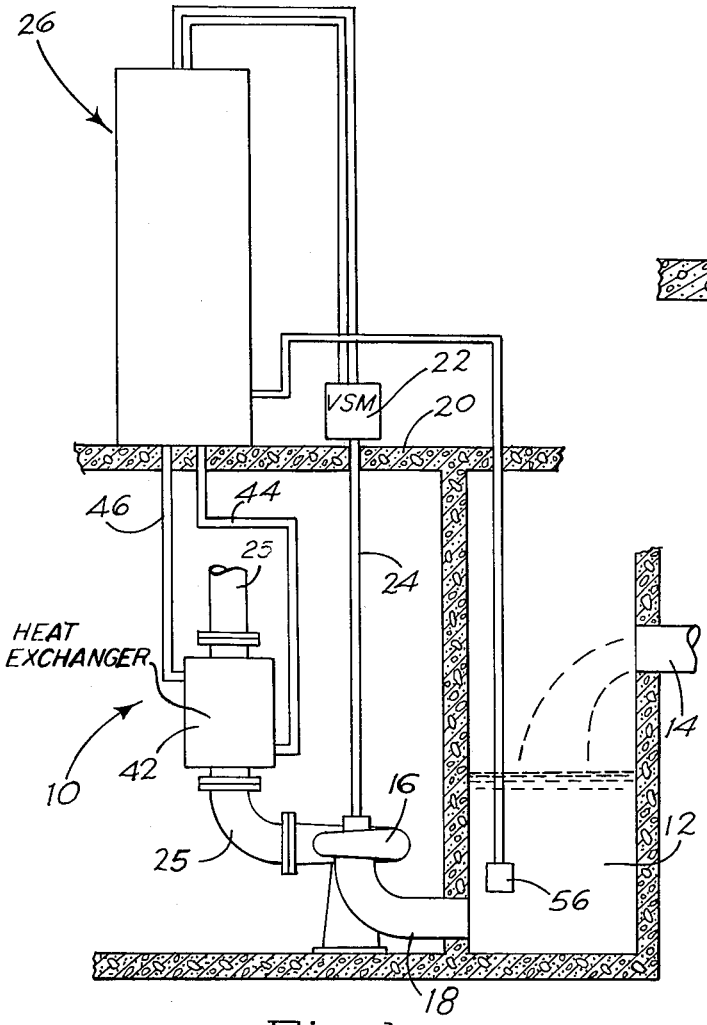
FIG. 1 is a side elevation view, taken partially in cross-section, of a pumping station and schematically illustrates a pumping apparatus according to the present invention for pumping liquid from a well.

Turning now to the drawings, and with reference directed initially to FIG. 1, there is illustrated generally at 10 a pumping system or station including apparatus for pumping liquid from a sump or well 12. As shown, a pipe 14 conducts influent liquid into the well and a pump means such as primary pump 16 is provided with an inlet 18 for pumping liquid from the well. Pumping station 10 is provided with a top wall 20 (as at ground level) upon which is mounted a variable speed electric motor, such as a wound rotor motor, indicated at 22. Motor 22 is operably interconnected by means of a shaft 24 to pump 16 for driving it so that liquid in well 12 may be pumped from inlet 18 through a discharge pipe 25.

As is conventional, motor 22 may be a three-phase wound rotor motor having its rotor circuit connected to a liquid rheostat. For instance, and with reference also directed to FIG. 2, it can be seen that motor 22 has its speed controlled by a liquid rheostat generally indicated at 24. Liquid rheostat 24 is mounted in a unitary cabinet assembly generally indicated at 26 and includes an electrode compartment 28 positioned above an electrolyte solution reservoir 30. The liquid rheostat may be of the type described in applicant's copending U.S. patent application Ser. No. 699,614 now issued as U.S. Pat. No. 4,107,641. The liquid rheostat includes three electrodes indicated at 32, 34 and 36 operatively connected by leads to the rotor circuit of motor 22 for controlling the speed thereof depending upon electrolyte solution level in the compartment. Drain means are provided in a bottom wall 38 of the compartment so that electrolyte solution is permitted to drain from compartment 28 into reservoir 30. One such drain means is shown as an orifice at 40.

Figure 2:
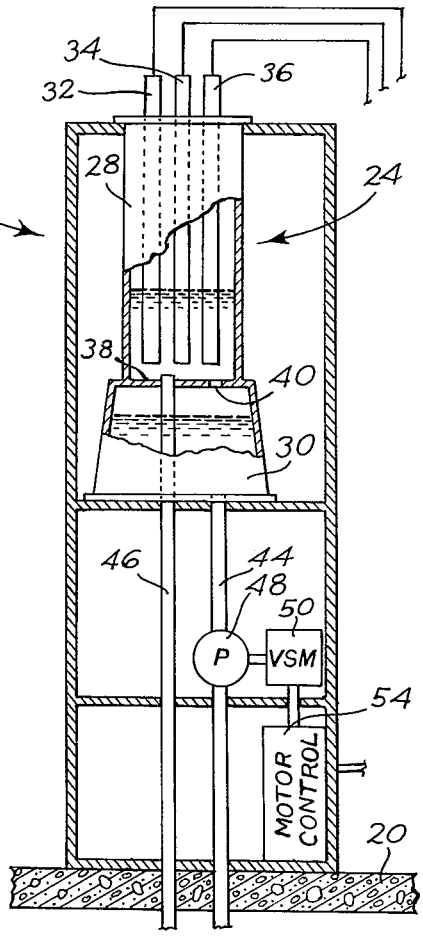
FIG. 2 is an enlarged side elevation view, with portions in cross-section and broken away, of a cabinet assembly housing a liquid rheostat and a circulating pump driven by a variable speed electric motor according to the present invention.

With reference directed to both FIGS. 1 and 2, it can be seen that a heat exchanger 42 is positioned to surround discharge pipe 25 and a conduit means such as conduit 44 extends from reservoir 30 to the heat exchanger. A discharge conduit 46 extends from the heat exchanger upwardly through the reservoir for discharge into compartment 28. It is to be noted that a circulating pump 48 is provided in conjunction with conduits 44, 46 for circulating electrolyte solution from reservoir 30 through heat exchanger 42 for discharge into compartment 28. Circulating pump 48 is driven by a second electric motor, of the variable speed type. Thus, is can be seen that if pump 48 is driven at a rate to produce electrolyte solution flow in conduit 46 at a flow rate greater than drainage through the orifice 40, electrolyte solution level will rise in compartment 28 thereby decreasing the resistance between the electrodes. This would produce a higher operating speed of motor 22 and consequently a greater flow rate production of pump 16.

Figure 3:
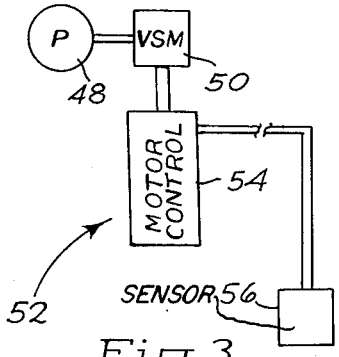
FIG. 3 is a functional block diagram view of a circulating pump, its variable speed electric motor, the motor control and a sensor in accordance with the present invention.

As mentioned previously, known liquid rheostats used in pumping apparatus are provided with a circulating pump which is continuously driven at a constant speed and flow from the reservoir to the electrode compartment is controlled by a regulating valve. In accordance with the present invention, it must be appreciated that circulating pump 48 is driven by a variable speed motor 50 and thus the electrolyte solution level in compartment 28 may be controlled by varying the speed at which motor 50 operates. The speed of motor 50 is controlled by a control means generally indicated at 52 and shown in FIG. 3. More specifically, control means 52 includes a motor control 54 which is operatively interconnected to motor 50 and to a sensor 56. As shown in FIG. 1, sensor 56 is immersed in the liquid in well 12 and may be of any suitable type operable for producing an electrical signal to motor control 54. As an example, sensor 56 may sense variations in pressure reflective of different levels of liquid in well 12. Depending upon the pressure, proportional electrical signals will be generated to motor control 54 which will in turn operate to vary the speed of motor 50 and correspondingly the pumping rate of circulating pump 48. Electrolyte solution level in compartment 28 may thereby be regulated.

It is to be noted that sensor 56 may be any suitable type of sensor such as a probe for determining level of liquid in well 12, and may be pressure sensitive for producing a small electrical signal of, for example, 4–20 milliamperes. It is contemplated that motor control 54 is provided with suitable electronic circuitry for receiving a signal from sensor 56 and providing an output signal to the rotor circuit of motor 50 for proportionate varying of the speed of the motor depending upon the signal received from the sensor.

It is contemplated that motor 50 may be of the AC or DC type with magnetic or eddy current coupling. The important thing to remember is that the motor must be of the variable speed type so that it is operable for driving circulating pump 48 at variable pumping rates depending upon the depth of liquid in well 12. Additionally, it is to be noted that the provision of motor control 54 enables all the major components, such as liquid rheostat 24, circulating pump 48 and its motor 50 and the motor control itself to be mounted in a unitary cabinet assembly such as indicated at 26. Significant space savings and resultant economies are thus achieved.

Explaining the operation of the present invention, and more particularly the special advantages of providing a circulating pump which may be driven at variable speeds for regulating electrolyte solution level, it is to be remembered that it is generally desired to maintain the liquid level in well 12 generally at a predetermined depth, at least within a given range. Thus, it can be appreciated that the flow rate produced by pump 16 must be substantially equalized with the influent flow of liquid from pipe 14 into the well. By way of example, let it be initially assumed that the flow rates through pipe 14 and pump 16 are substantially the same. In this condition, circulating pump 48 will be driven at a predetermined rate so that the electrolyte solution level in compartment 28 is maintained at a preselected level. In order for a particular electrolyte solution level to be maintained in compartment 28, the circulating pump must be driven at a rate which overcomes the rate through which electrolyte drains through orifice 40.

If the influent rate of liquid through conduit 14 is now increased, the depth in well 12 will correspondingly increase and this will be sensed by sensor 56. An electrical signal is generated from sensor 56 to motor control 54 and motor 50 is then directed to operate at a higher speed. The higher speed drives circulating pump 48 at an increased rate, and more electrolyte solution is pumped from reservoir 30, through heat exchanger 42 and upwardly through conduit 46 into compartment 28. This results in an increase in electrolyte solution level in the compartment which decreases the resistance of the rotor circuit of motor 22. With the decrease in resistance, motor 22 speeds up to drive pump 16 at a faster rate which increases the flow rate of liquid through inlet pipe 18 for discharge through outlet pipe 25. Thus, it may be appreciated that motor 50 may be conveniently operated to increase the pumping rate of pump 16.

Similarly, if there is a decrease in influent liquid from pipe 14, the liquid level in well 12 will drop and this is sensed by sensor 56. A smaller signal is generated from the sensor to motor control 54 and motor 50 is directed to operate at a lower speed. This results in circulating pump 48 being driven at a lower rate and the electrolyte solution level in compartment 28 decreases thereby increasing the resistance in the rotor circuit of motor 22. Motor 22 is then driven at a lower speed which decreases the pumping rate of pump 16 and the resultant flow rate of liquid through pipe 18 and outlet 25. Once again, a balancing of the influent liquid flow rate and outlet flow rate is maintained so that the liquid level in well 12 remains relatively constant over a given range.

It should be appreciated that the present invention provides several significant advantages. First of all, balancing of influent flow rate into the well with the outflow rate is accomplished by a significantly less complex apparatus than has been heretofore available. Specifically, the level of electrolyte solution in compartment 28 is determined by circulating pump 48 which may be driven to pump at different rates by variable speed motor 50. The speed at which motor 50 is driven is determined by motor control 54 which receives a signal from sensor 56. As explained previously, prior art systems have required the use of valves in order to regulate electrolyte solution level from a reservoir to an electrode compartment. Such valving is generally pneumatically controlled, and an electrical signal from a well sensor must be converted into a pneumatic signal. Such pneumatic controllers are generally expensive, and occupy additional space as well as being somewhat unreliable and subject to malfunctioning after extended use.

In contrast, the present invention is directed to the concept of providing a circulating pump which may be driven at variable rates so that the electrolyte solution level in an electrode compartment of a liquid rheostat may be increased by driving circulating pump at a rate higher than the rate at which the electrolyte solution drains into the rheostat's solution reservoir. Conversely, if it is desired to lower the level of electrolyte solution in the compartment, the circulating pump 48 may be driven at a lower rate. Greater reliability results from the simplicity of the present invention.

It is also to be noted that the motor control may be conveniently mounted in cabinet assembly 26 so that it is positioned adjacent to circulating pump 48 and variable speed motor 50. This facilitates maintenance and also enables use of attractive, enclosed cabinets.

While the invention has been particularly shown and described with reference to the foregoing preferred embodiment, it will be understood by those skilled in the art that other changes in form and detail may be made without departing from the spirit and scope of the invention as defined in the appended claims.

It is claimed and desired to secure by Letters Patent:

1. Apparatus for pumping liquid from a well comprising:

pump means driven by a variable speed electric motor operable for pumping liquid from the well;

a liquid rheostat operatively connected to said electric motor for controlling the speed thereof, said liquid rheostat including an electrode compartment and an electrolyte solution reservoir, said compartment including drain means for permitting solution contained therewithin to be drained into said reservoir;

a circulating pump driven by a second variable speed electric motor operable for circulating solution from said reservoir to said compartment through a conduit; and control means operable for selectively regulating motor speed of said circulating pump in response to the amount of liquid in the well to thereby regulate solution level in said compartment.

2. The apparatus of claim 1 wherein said control means includes a sensor and a motor control, said sensor being immersed in the well and operable for producing a signal to said motor control reflective of the level of liquid in the well, said motor control including means operable for varying the motor speed of said circulating pump in response to a signal from said sensor.

3. The apparatus of claim 2 wherein said electrode compartment is positioned above said reservoir, said drain means including an orifice extending through a bottom wall of said compartment into said reservoir.

4. The apparatus of claim 3 wherein said liquid rheostat, said circulating pump and its motor and said motor control are mounted in a unitary cabinet assembly.

5. The apparatus of claim 3 wherein a heat exchanger is provided in conjunction with said conduit, said heat exchanger surrounding a portion of the outlet of said pump means.

6. In a liquid rheostat operatively interconnected to a variable speed electric motor and a pump means for pumping liquid from a well, said liquid rheostat including an electrode compartment and an electrolyte solution reservoir, the improvement comprising:

drain means for permitting solution in the compartment to be drained into the reservoir;

conduit means interconnecting the reservoir and the compartment;

a circulating pump driven by a second variable speed electric motor operable for circulating solution through said conduit means from the reservoir to the compartment; and control means operable for selectively regulating motor speed of said circulating pump in response to the amount of liquid in the well to thereby regulate solution level in the compartment.

7. The liquid rheostat of claim 6 wherein said control means includes a sensor and a motor control, said sensor being operable for producing a signal to said motor control reflective of the level of liquid in the well, said motor control operable for varying the motor speed of said circulating pump in response to a signal from said sensor.

8. The liquid rheostat of claim 7 wherein said sensor is adapted for being immersed in the well and for producing an electrical signal generally in the range of 4–20 milliamperes.

9. A method for regulating electrolyte solution level in a liquid rheostat, said liquid rheostat being used in a system for pumping liquid from a well and including an electrode compartment interconnected by a conduit to an electrolyte solution reservoir comprising:

circulating the solution through the conduit from the reservoir to the compartment by a motor-driven circulating pump;

sensing liquid level in the well; and controlling the circulating rate of said circulating pump in response to changes in the amount of liquid in the well by controlling the motor speed of the circulating pump.

* * * * *